United States Patent [19]

Brooks

[11] 4,272,899

[45] Jun. 16, 1981

[54] FOOTWEAR

[76] Inventor: Jeffrey S. Brooks, 11630 Chieftain Dr., St. Louis County, Mo. 63141

[21] Appl. No.: 84,832

[22] Filed: Oct. 15, 1979

[51] Int. Cl.[3] ..... A43B 5/00; A43B 23/08

[52] U.S. Cl. ..... 36/129; 36/69

[58] Field of Search ..... 36/71, 58.5, 68, 69, 36/80, 11.5, 129

[56] References Cited

U.S. PATENT DOCUMENTS

| | | | |
|---|---|---|---|
| 2,097,759 | 11/1937 | Ehrlich | 36/71 |
| 2,255,100 | 9/1941 | Brady | 36/71 |
| 3,068,872 | 12/1962 | Brody | 36/68 |
| 3,333,353 | 8/1967 | Garcia | 36/69 |
| 4,137,654 | 2/1979 | Hlavac | 36/69 |
| 4,168,585 | 9/1979 | Gleichner | 36/69 |

*Primary Examiner*—Patrick D. Lawson

*Attorney, Agent, or Firm*—Senniger, Powers, Leavitt and Roedel

[57] ABSTRACT

Footwear, such as a running shoe, comprising a sole and an upper, the sole having heel, arch and forefoot sections, and medial and lateral sides. The sole is so formed that when it is unstressed and disposed on a generally flat horizontal surface the upper foot-supporting surfaces of the heel and arch sections are inclined generally downwardly from the medial to the lateral side of the sole. The arch section at the medial side of the sole is constructed for supporting the bottom of the arch of the foot at a predetermined elevation in relation to the heel and forward part of the foot. The arch section is compressible at its medial side no more than a predetermined distance on impact of the shoe during running.

127 Claims, 15 Drawing Figures

FOOTWEAR

BACKGROUND OF THE INVENTION

This invention relates generally to footwear and more particularly to an improved running shoe.

From an anatomical standpoint, a normal or flat foot differs considerably from a high-arch foot. For example, the amount of adduction (pigeon-toedness) of the front part of a normal or flat foot in relation to the rear part of the foot is typically relatively small, while the amount of adduction in a high-arch foot is much greater. The movement of the normal or flat foot during running is also substantially different than that of the high-arch foot.

However, the differences both in anatomy and movement between the flat or normal foot and the high-arch foot have not been taken into consideration in designing and marketing running shoes. Rather, running shoes have been sold merely by shoe size, with one size being sold to fit all persons having feet of that same size, irrespective of the type of foot the person may have. As a result, only a small percentage of persons buying running shoes receive a pair suitable for their particular feet. The majority of persons receive shoes which are unsuitable and which fail to lend proper support to their feet, and this oftentimes leads to severe foot and leg problems.

Reference may be made to U.S. Pat. Nos. 4,137,654, 2,255,100 and 2,097,759 for footwear and associated items generally in the field of this invention.

SUMMARY OF THE INVENTION

Among the several objects of this invention may be noted that provision of improved footwear, such as a running shoe, especially adapted for use by persons having normal or flat feet; the provision of improved footwear especially adapted for use by persons having feet with relatively high arches; the provision of such footwear which supports the foot for providing an even distribution of body weight over the foot; and the provision of such footwear which is comfortable in use.

Generally, footwear of the present invention, such as a running shoe, comprises a sole and an upper, the sole having a heel section for the bottom of the heel of the foot, an arch section forward of the heel section for the bottom of the arch of the foot, a forefoot section forward of the arch section having a forward portion for supporting the metatarsal heads and toes of the foot and a rear portion for supporting the part of the foot immediately rearward of the metatarsal heads, and medial and lateral sides. The sole is so formed that when it is unstressed and disposed on a generally flat horizontal surface the upper foot-supporting surfaces of the heel and arch sections are inclined generally downwardly from the medial to the lateral side of the sole. The arch section at the medial side of the sole is elevated in relation to the forefoot section for supporting the bottom of the arch of the foot at an elevation of from 0.5–3 cm above a line which, as viewed from the medial side of the shoe, extends between the upper foot-supporting surface of the heel section and an area on the upper surface of the forward portion of the forefoot section generally corresponding to the area on which the first metatarsal head is adapted to lie, said 0.5–3 cm being measured from the top of the arch section at its medial side vertically downwardly to said line. The arch section is compressible at its medial side in relation to said line no more than 0.5 cm, as measured vertically downwardly from the top of the arch section, on impact of the shoe during running.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
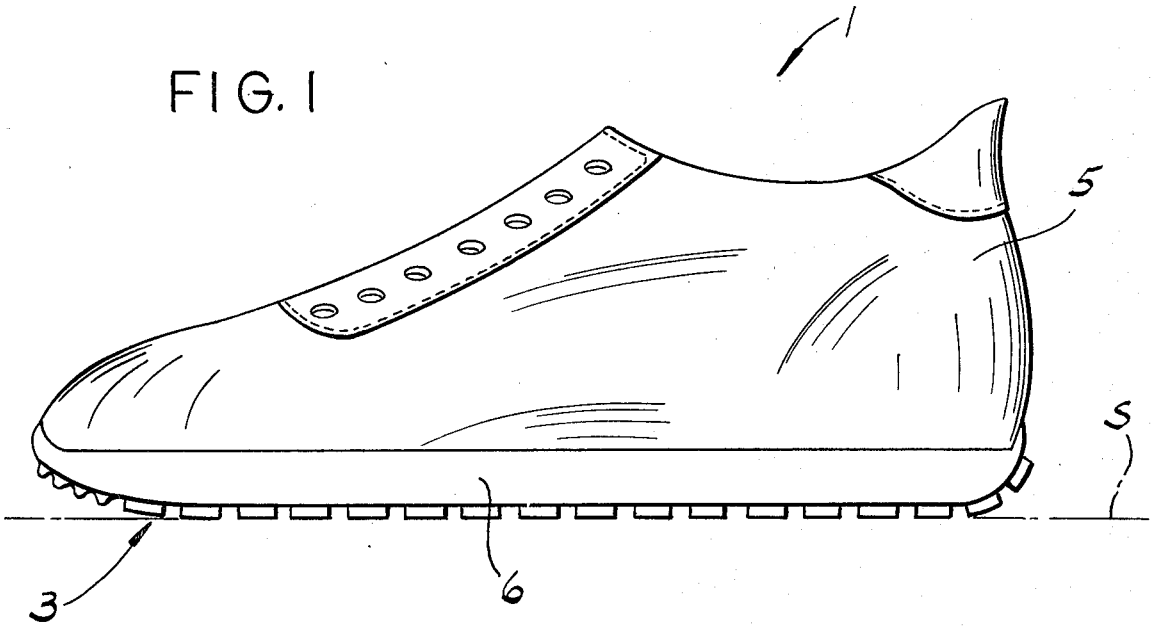
FIG. 1 is an elevation of a running shoe of this invention comprising a sole and an upper.

Referring now to FIG. 1 of the drawings, a running shoe is designated in its entirety by the reference numeral 1 and is shown as comprising a sole 3 and an upper 5. In accordance with this invention, the construction of the sole varies depending on the type of foot the shoe is designed to fit. Thus the sole 3A shown in FIGS. 2–8 is especially adapted for persons having either normal or relatively flat feet, and the sole 3B depicted in FIGS. 9–15 is especially suited for persons having feet with relatively high arches. While these soles are described herein as being particularly adapted for running shoes, it will be understood that they are also suitable for other types of shoes, and for footwear such as boots and sandals. Sole 3A will be described first, followed by a description of sole 3B.

Figure 2:
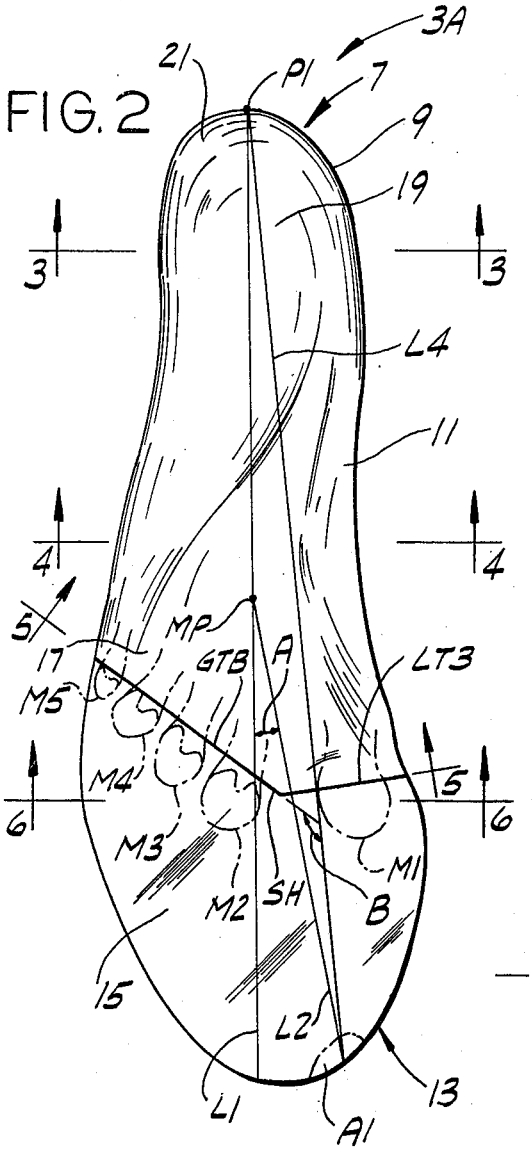
FIG. 2 is a plan of the sole of the shoe in FIG. 1, the sole being particularly adapted for persons having flat feet.

As shown in FIG. 2, the sole 3A comprises a lower or outer sole 6, which may be of rubber, for example, and formed with tread of a suitable pattern, and an insole 7 on the outer sole. The insole is of a suitable cushiony material and may be secured to the outer sole in conventional manner, as by gluing. The sole has three sections, namely, a heel section 9 for the bottom of the heel of the foot, an arch section 11 forward of the heel section for the bottom of the arch (the instep) of the foot, and a forefoot section 13 forward of the arch section. This latter section 13 has a forward portion 15 for the metatarsal heads (the ball of the foot) and for the toes of the foot, and a rear portion 17 for the part of the foot immediately rearward (proximal) of the metatarsal heads. The areas shown in phantom and designated M1–M5 in FIG. 2 generally correspond to the areas of the insole on which the metatarsal heads of a normal or flat foot are adapted to lie, M1 representing the area for the first metatarsal head, M2 for the second metatarsal head, . . . etc.

In both a normal and flat foot, the front part of the foot is adducted relative to the rear part of the foot, although not to a considerable degree. To accommodate this, the sole 3A is constructed with a 0°–12° angle of adduction, and preferably about a 9° angle of adduction. This angle is designated A in FIG. 2 and is the included angle between a first line L1 extending the length of the sole on the central longitudinal axis of the heel section 9, and a second line L2 extending from about the midpoint MP of line L1 to an area A1 adjacent the front edge of the forefoot section 13 of the insole corresponding approximately to the area at which the outer end of the second toe is adapted to lie.

The sole 3A is so formed that when it is unstressed and disposed on a generally flat horizontal surface, indicated in phantom at S, the upper foot-supporting surfaces of the heel and arch sections 9, 11 of the insole 7 are inclined generally downwardly from the medial (right) to the lateral (left) side of the shoe (see FIGS. 3 and 4) for supporting the heel and arch of the foot "in varus", and the upper foot-supporting surface of the rear portion 17 of the forefoot section 13 is inclined generally upwardly from the medial to the lateral side of the shoe (FIG. 6) for supporting the part of the foot immediately forward of the arch (i.e., the metatarsals) "in valgus". For reasons which will appear hereinafter, the upper surface of the forward portion 15 of the forefoot section 13 is offset downwardly from the upper surface of the rear portion 17, forming a shoulder SH at the juncture of these two portions 15, 17 of the insole. As viewed from the top of the sole (FIG. 2), this shoulder SH angles forwardly from the lateral (left) toward the medial (right) side of the shoe along what is referred to as a great toe break line, designed GTB, and then generally transversely of the sole to the medial side of the shoe along a lesser toe break line designated LTB. As will be discussed in more detail hereinafter, the sole is formed for flexing generally along these lines during the push-off stage of a running stride, hence the term "toe break". The upper surface of the forward portion 15 of the forefoot section 13 lies in a generally horizontal plane for supporting the metatarsal heads and toes of the foot.

Figure 3:
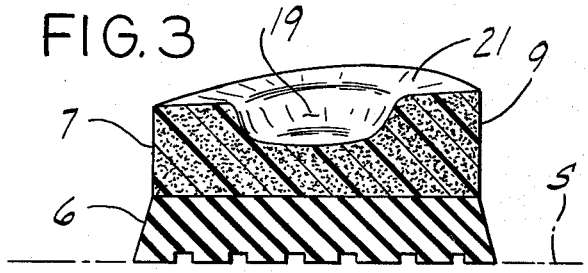
FIG. 3 is a vertical section on line 3—3 of FIG. 2.

As indicated at 19, the heel section 9 of the insole 7 is depressed at its center, forming a recess to receive the central portion of the bottom of the heel, the remainder of the heel being adapted to be supported on the generally U-shaped surface 21 bounding the recess (FIG. 3). This construction reduces pressure on the heel during running, thereby inhibiting the formation of heel spurs and reducing plantar facial strain. The U-shaped upper surface 21 of the heel section is inclined for supporting the heel in varus, preferably at about a 3° angle from the horizontal, although this angle may range from 1°–6° without departing from the scope of this invention.

Figure 4:
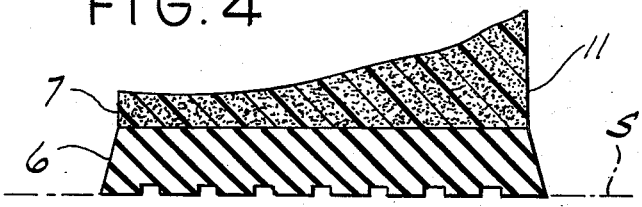
FIG. 4 is a vertical section on line 4—4 of FIG. 2.

As shown in FIG. 4, the arch section 11 of the insole is also sloped for supporting the bottom of the arch of the foot in varus, with the angle of slope being relatively great toward the metal (right) side of the shoe and decreasing toward the lateral (left) side. As viewed from the medial side of the shoe (FIG. 7), the arch section 11 is elevated in relation to the forward portion 15 of the forefoot section 13 and in relation to the heel section 9 for providing proper support for the bottom of the arch of the foot at the talo-navicular joint. More specifically, the arch section is formed for supporting the bottom of the arch at the talo-navicular joint at an elevation of from 0.5–3 cm above a line L3 which, as viewed in FIG. 7, extends between the upper foot-supporting surface of the heel section 9 and the area M1 on the upper surface of the forward portion 15 of the forefoot section 13. The 0.5–3 cm distance referred to is a vertical dimension measured from the top of the arch section 11 vertically downwardly to line L3, and is identified by the reference character d. The magnitude of this dimension d will vary, depending on the age of the person for which the shoe is designed. For example, for adults (persons 17 years of age and older) the dimension is preferably about 2 cm; for persons 10–17 years old, about 1.5 cm; for persons 7–10 years old about 1.0 cm; and for persons 2–7 years old about 0.5 cm. To provide proper support for the arch of the foot during running, the arch section 11 of the insole should be compressible at its medial side in relation to line L3 no more than about 0.5 cm, as measured vertically downwardly from the top of the arch, on impact of the shoe during running. That is, the dimension d should be reduced by no more than about 0.5 cm on impact of the shoe during running. Where dimension d is less than 1 cm (i.e., in a sole for persons 2–7 years old), the arch section should be compressible at its medial side no more than about 0.25 cm on impact of the shoe.

The construction of the sole 3A to support the heel of the foot in varus and the bottom of the arch at the proper elevation is an important aspect of this invention in that this tends to normalize the movements of the flat foot in the shoe and to reduce the wasted foot motion associated with persons having flat feet. Some background is necessary in this regard.

When walking and running, the lateral (outside) portion of the heel is generally the first part of a foot to strike the running surface, with the foot then pivoting on the heel to bring the lateral portion of the forefoot into contact with the surface. At this point the foot is supinated (inclined upwardly from the lateral to the medial side of the foot), but it rapidly pronates, bringing the foot into a neutral position in which the bottom of the heel and the five metatarsal heads of the forefoot are in contact with the running surface, and in which the central vertical plane of the heel is generally perpendicular to the running surface. During this sequence of foot movement, various muscles and tendons in the foot contract to stabilize the foot in preparation for movement of the foot from its neutral position back to a supinated position prior to push-off. One such muscle is the peroneous longus muscle which extends along the lateral side of the foot and thence beneath the cuboid bone which serves as a pulley to direct the muscle diagonally forward below the bony structure of the foot for attachment to the base of the first ray of the foot, the latter of which comprises the first cuneiform and the first metarsal bones. During pronation of the foot, the contraction of the peroneous longus muscle pulls the base of the first ray proximally (rearwardly), laterally and downwardly to stabilize it against proximal and lateral bones of the foot and against the running surface on impact of the medial side of the foot. Proper stabilization of the first ray of the foot, and the second through the fifth rays of the foot, is important to ensure that all five metatarsals are stably planted on the running surface in their neutral position prior to push-off for uniform distribution of body weight over all five metatarsals.

The motion of a flat foot during running deviates from that described above in that the tendons and muscles of the foot do not function on impact of the foot to properly stabilize the foot. Instead, the entire foot pronates considerably past the neutral position and into valgus, causing the first metatarsal to swing up about its axis relative to the second through the fifth metatarsals. In this position, contraction of the peroneous longus muscle is unable to stabilize the first metatarsal head against the running surface so as to make it weight-receptive. This results in uneven weight distribution on the foot, with excessive weight being carried by the second through the fifth metatarsals. The sole 3A of the shoe of the present invention is constructed to overcome this weight distribution problem. Thus, by supporting the heel of the foot in varus and the bottom of the arch of the foot at the proper elevation, the sole prevents excessive pronation of the foot beyond the neutral position, thereby enabling the peroneous longus muscle to stabilize the first metatarsal and to make it weight-receptive for establishing an even weight distribution over all five metatarsal heads of the foot.

Figure 6:
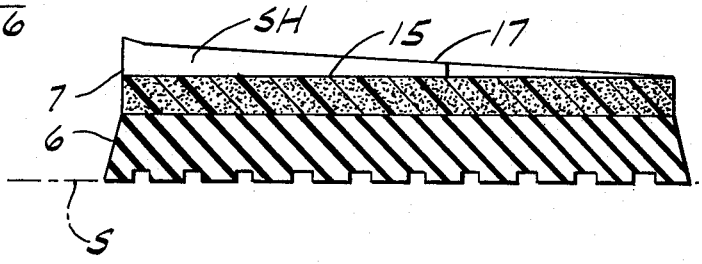
FIG. 6 is a vertical section on line 6—6 of FIG. 2.

The rear portion 17 of the forefoot section 13 is inclined for supporting the part of the foot immediately forward of the arch (e.g., the metatarsals) in valgus, preferably at about a 3° angle from the horizontal, although this angle may vary from 1°–6° (see FIG. 6). The rear portion 17 terminates at shoulder SH which extends along the great and lesser toe break lines GTB, LTB immediately rearward of areas M1–M5. The great toe break line may be located in reference to a line L4 which extends from area A1 at the front edge of the insole to the point P1 at which line L1 intersects the rear edge of the heel section 9 of the sole. The angle B between this line L4 and the great toe break line GTB is from 120°–160° and preferably about 135°. The construction is such that the rear portion 17 of the forefoot section 13 supports the metatarsals along substantially their entire length at an elevation above that of the metatarsal heads and toes of the foot, which is desirable in that this properly positions the front part of the foot for maximum efficiency of movement.

Figure 5:
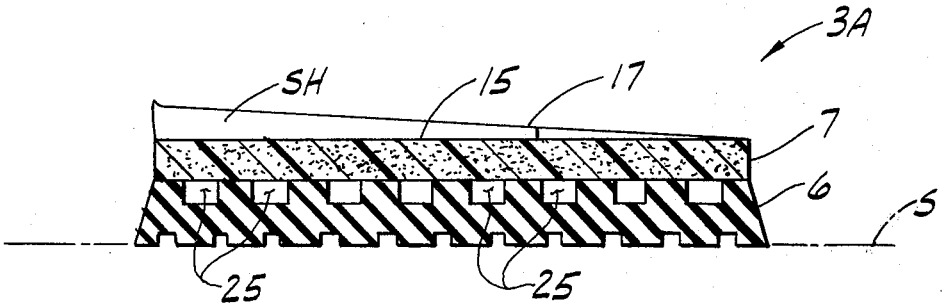
FIG. 5 is a vertical section on line 5—5 of FIG. 2.
Figure 12:
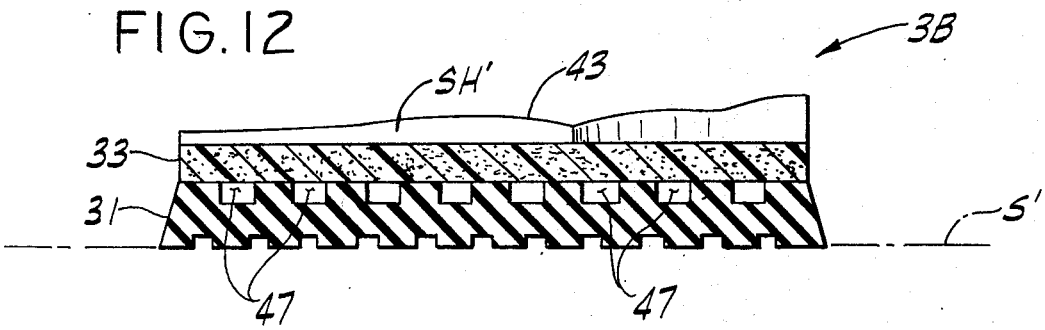
FIG. 12 is a vertical section taken on line 12—12 of FIG. 9.

As best shown in FIG. 5, the outer sole 6 is formed with a plurality of cavities 25 therein generally in the area of the juncture of the rear and forward portions 15, 17 of the forefoot section 13 of the sole. These cavities weaken the sole and readily enable it to flex along the great and lesser toe break lines GTB, LTB for an effective toe push-off during running. Other means for weakening the sole to ensure flexibility in this area may also be suitable.

Figure 7:
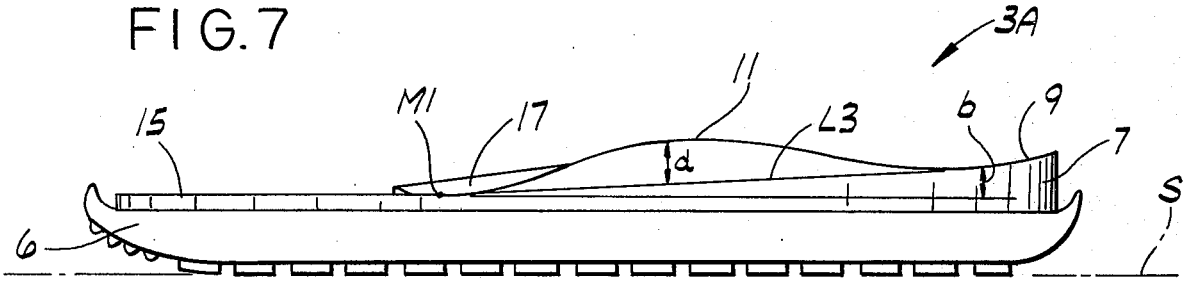
FIG. 7 is a medial side elevation of the sole of FIG. 2.
Figure 8:
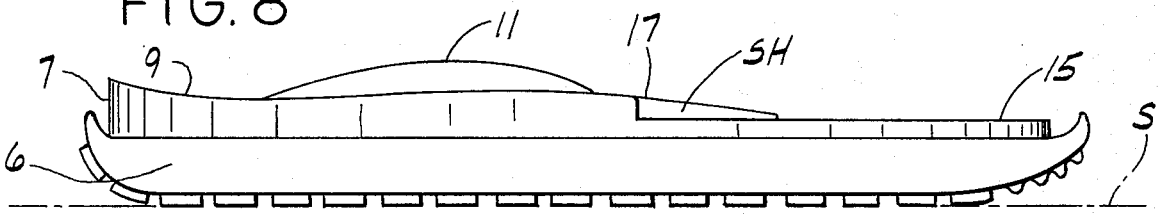
FIG. 8 is a lateral side elevation of the sole of FIG. 2.
Figure 9:
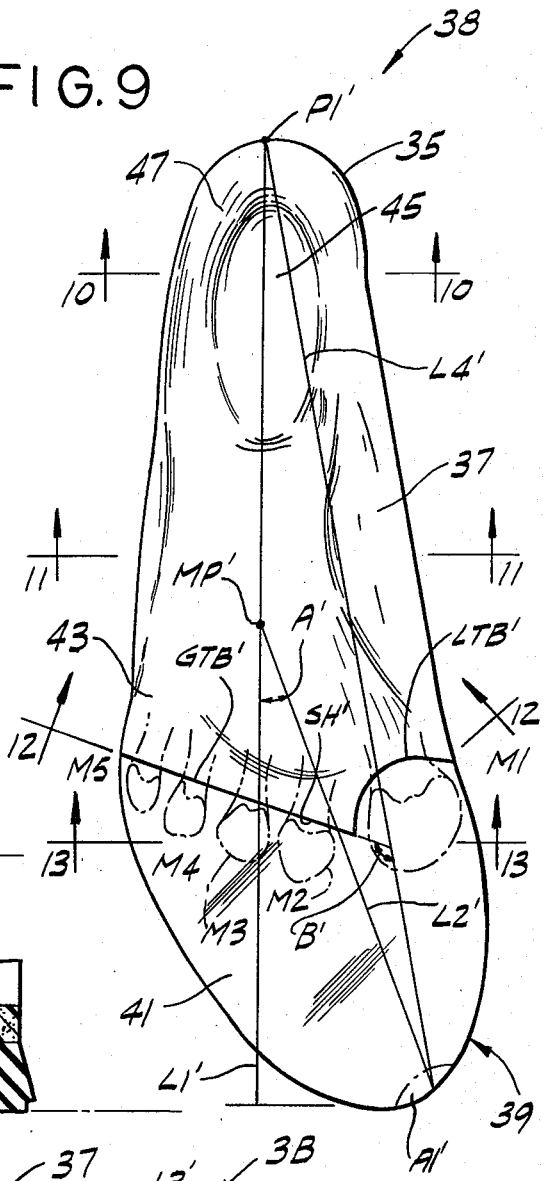
FIG. 9 is a plan of a sole particularly adapted for persons having feet with relatively high arches, the upper not being shown.

The sole 3A is formed for supporting the central portion of the bottom of the heel at an elevation higher than the bottom of the foot at the ball of the foot (i.e., at the metatarsal heads of the foot). Preferably this difference in elevation, which is represented by the reference numeral b in FIG. 7, is about 0.6 cm (about ¼ in.).

Referring now to FIGS. 9–15, sole 3B, which is particularly adapted for persons having feet with relatively high arches, is shown as comprising a lower outer sole 31 and an insole 33 on the outer sole. The outer sole and insole are of the same material as the outer sole 6 and the insole 7 described above. The sole 3B comprises heel, arch and forefoot sections indicated at 35, 37, 39, respectively, and the forefoot section has forward and rear portions 41 and 43 comparable except as hereinafter noted with those previously described in regard to sole 3A. The areas shown in phantom and designated M1–M5 in FIG. 9 generally correspond to the areas of the insole 33 on which the first through the fifth metatarsal heads of a high-arch foot are adapted to lie.

In view of the fact that in a foot with a relatively high arch the front part of the foot is adducted relative to the rear part of the foot to a much greater degree than in a normal or flat foot, sole 3B is formed with an angle of adduction A′ which is considerably greater than the angle of adduction A of sole 3A. In this regard, the angle of adduction A′ is from 13°–33° (compared to 0°–12° for sole 3A), and preferably about 17° (as compared to 9° for sole 3A). The angle A′ is measured between a first line L1′ extending the length of the sole on the central longitudinal axis of the heel section 35 (FIG. 9), and a second line L2′ extending from about the midpoint MP′ of line L1′ to an area A1′ on the front edge of the forefoot section 39 corresponding approximately to the area at which the outer end of the second toe is adapted to lie.

The sole 3B is so formed that when it is unstressed and disposed on a generally flat horizontal surface, indicated in phantom at S′, the upper foot-supporting surfaces of the heel and arch sections 35, 37 of the insole 33 and the upper surface of the rear portion 43 of the forefoot section 39 are inclined generally downwardly from the medial (right) to the lateral (left) side of the shoe for supporting respective parts of the foot in varus (see FIGS. 3, 4 and 6). The upper surface of the forward portion 41 of the forefoot section 39 extends generally horizontally and is downwardly offset from the upper surface of the rear portion 43, forming a shoulder SH′ at the juncture of these two portions 41, 43. As viewed from the top of the shoe (FIG. 9), this shoulder SH′ extends from the lateral to the medial side of the shoe immediately rearward of areas M1–M5 along great and lesser toe break lines designated GTB′ and LTB′ respectively. The great toe break line GTB′ may be located in reference to a line L4′ (FIG. 9) which extends from the area A1′ at the front edge of the insole 33 to the point P1′ at which line L1′ intersects the rear edge of the heel section 35. The angle B′ between this line L4′ and the great toe break line GTB is from 110°–150° (compared to 120°–160° for sole 3A), and preferably about 125° (compared to 135° for sole 3A). The lesser toe break line, which extends immediately rearward of the area M1, is curved to conform to the first metatarsal head. The construction is such that the rear portion 43 of the forefoot section 39 supports the metatarsals along substantially their entire length at an elevation above that of the metatarsal heads and toes of the foot, which is desirable in that this properly positions the front part of the foot for maximum efficiency of movement.

Figure 10:
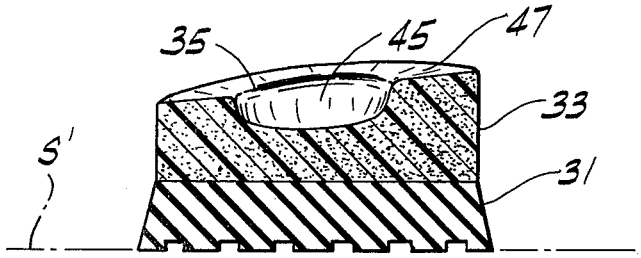
FIG. 10 is a vertical section taken on line 10—10 of FIG. 9.
Figure 11:
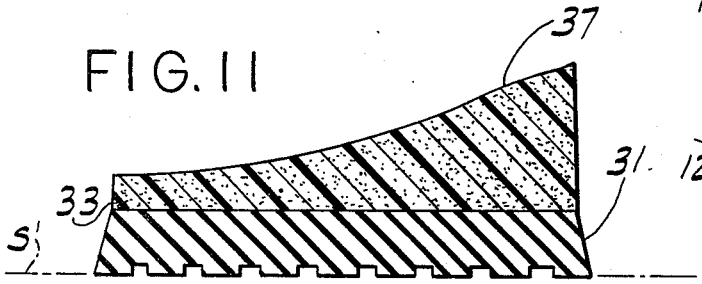
FIG. 11 is a vertical section taken on line 11—11 of FIG. 9.
Figure 13:
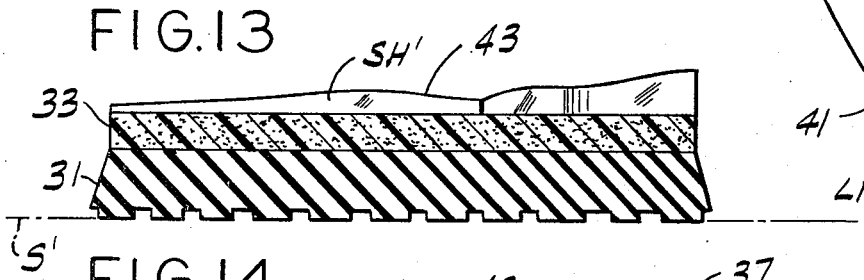
FIG. 13 is a vertical section taken on line 13—13 of FIG. 9.
Figure 14:
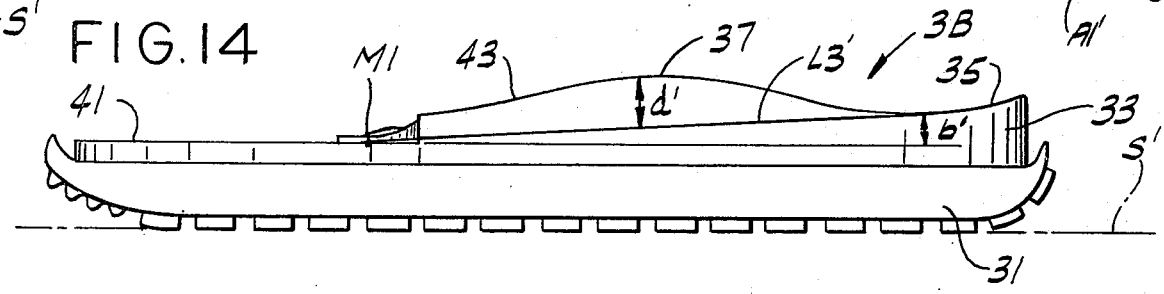
FIG. 14 is a medial side elevation of the sole of FIG. 9.
Figure 15:
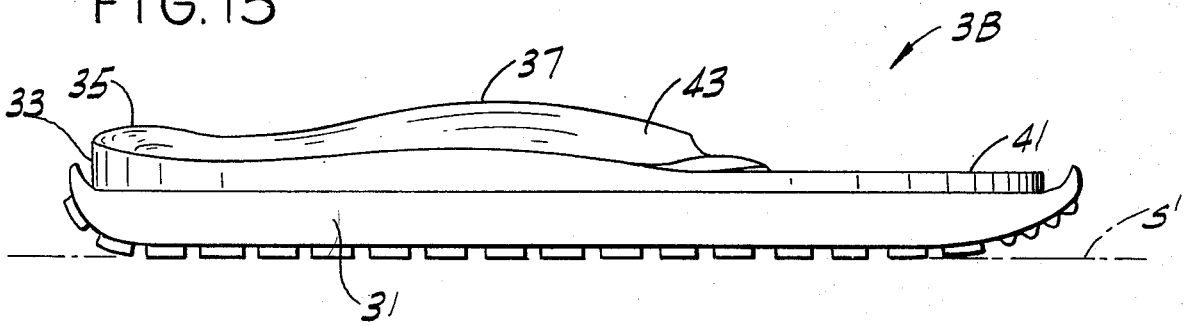
FIG. 15 is a lateral side elevation of the sole of FIG. 9.

The heel section 35 of sole 3B is substantially identical to the heel section 9 of the sole 3A described above, having a central recess 45 therein for receiving the central portion of the bottom of the heel, with the remainder of the heel being adapted to be supported on the generally U-shaped surface 47 bounding the recess (FIG. 10). This U-shaped surface is inclined for supporting the heel in varus at an angle of 2°–7° from the horizontal, and preferably at about a 5° angle. This angle is somewhat greater than the preferable 3° angle of inclination for the heel section 9 of sole 3A since the heel of a high-arch foot tends to remain in varus during foot contact with the running surface rather than leveling out as in a normal or flat foot.

The arch section 37 of the sole 3B is also essentially identical to the arch section 11 of sole 3A. Thus, as viewed from the medial side of the shoe (FIG. 14), the arch section is elevated in relation to the forward portion 41 of the forefoot section 39 and in relation to the heel section 35 for supporting the bottom of the arch of the foot at the talo-navicular joint at an elevation of from 0.5–3 cm above a line L3′ which, as viewed in FIG. 14, extends from the upper foot-supporting surface of the heel section 35 to the area M1 of the upper surface of the forward portion 41 of the forefoot section 39. The 0.5–3 cm distance referred to is a vertical dimension measured from the top of the arch section 37 vertically downwardly to line L3′ and is identified by the reference character d′. The magnitude of this dimension d′ will vary, depending on the age of the person for which the shoe is designed. For example, for adults the dimension is preferably about 2 cm; for persons 10–17 years old, about 1.5 cm; for persons 7–10 years old, about 1.0 cm; and for persons 2–7 years old, about 0.5 cm. To provide proper support for the arch of the foot during running, the arch section 37 of the insole should be compressible at its medial side in relation to line L3′ (no more than about 0.5 cm, as measured vertically downwardly from the top of the arch, on impact of the shoe during running. That is, the dimension d′ should be reduced by no more than about 0.5 cm on impact of the shoe during running. Where dimension d′ is less than 1 cm (i.e., in a shoe for a person 2–7 years old), the arch section should be compressible at its medial side no more than about 0.25 cm on impact of the shoe.

The rear portion 43 of the forefoot section 39 is inclined for supporting the metatarsals of the foot in varus at preferably about a 3° angle from the horizontal, although this angle may vary from 2°–5°. This construction is important to accommodate the anatomical abnormalities of a high-arch foot which tends to stabilize (rigidize) too quickly after impact, thereby preventing the foot from pronating to the aforementioned neutral position of a normal foot. Instead, the second through the fifth metatarsals are stabilized by the muscles and tendons of the foot in an excessively supinated position (i.e., in varus). With the foot in this position, the peroneous longus muscle acts to plantarflex or swing the first metatarsal head down to a position which is excessively low in relation to the adjacent lateral bones. The heel also tends to remain in varus, rather than leveling off to a position in which its central vertical axis is generally perpendicular to the running surface, as in a normal foot. Thus, unless a shoe is properly designed, an uneven load distribution on the foot results, with the lateral side of the heel and the first and fifth metatarsal heads bearing an excessive amount of body weight. Jamming of the first metatarsal against the proximal bones on impact of the foot also presents a problem, especially during running when the foot is subjected to high stresses. The fact that the rear portion 43 of the forefoot section 39 is inclined upwardly from the lateral to the medial side of the foot avoids these weight distribution and jamming problems in that the sole 3B supports the second through the fifth metatarsals in their supinated position and allows them to bear their proportionate share of body weight.

Like the outer sole 6 of sole 3A, the outer sole 31 of sole 3B is formed with a plurality of cavities 47 therein generally in the area of juncture of the rear and forward portions 41 and 43 of the forefoot section 39 of the sole. These cavities weaken the sole and enable it readily to flex along the great and lesser toe break lines GTB′ and LTB′.

The sole 3B is formed for supporting the central portion of the bottom of the heel at an elevation of about 0.6 cm (about ¼ in.) higher than the bottom of the ball of the foot. This difference in elevation is represented by the reference numeral b′ in FIG. 14.

The insoles 7 and 33 described above are also adapted for placement on the outer soles of shoes not made in accordance with this invention. In this connection, the existing sole of the shoe is removed and an insole of the present invention placed on the outer sole of the shoe. It may be secured in position with a suitable adhesive, for example. The forward portion of the forefoot section of the insole should be trimmed, if necessary, to fit inside the shoe atop the outer sole.

It will be apparent from the foregoing, that footwear, such as running shoe 1, comprising sole 3A is especially adapted for use for persons having normal or flat feet and is constructed for supporting the foot to provide an even distribution of body weight over the foot. Footwear comprising sole 3B, on the other hand, is especially adapted for use by persons having feet with relatively high arches and is also constructed for effective support of the foot to provide for even distribution of body weight over the foot.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Footwear, such as a running shoe, comprising a sole and an upper, the sole having:

(a) a heel section for the bottom of the heel of the foot;

(b) an arch section forward of the heel section for the bottom of the arch of the foot;

(c) a forefoot section forward of the arch section having a forward portion for supporting the metatarsal heads and toes of the foot and a rear portion for supporting the part of the foot immediately rearward of the metatarsal heads;

(d) medial and lateral sides;

the sole being so formed that when it is unstressed and disposed on a generally flat horizontal surface:

(e) the upper foot-supporting surfaces of said heel and arch sections are inclined generally downwardly from the medial to the lateral side of the sole;

(f) the arch section at the medial side of the sole being elevated in relation to the forefoot section for supporting the bottom of the arch of the foot at an elevation of from 0.5–3 cm above a line which, as viewed from the medial side of the shoe, extends between the upper foot-supporting surface of the heel section and an area on the upper surface of the forward portion of the forefoot section generally corresponding to the area on which the first metatarsal head is adapted to lie, said 0.5–3 cm being measured from the top of the arch section at its sole side vertically downwardly to said line;

(g) the arch section being compressible at its medial side in relation to said line no more than about 0.5 cm, as measured vertically downwardly from the top of the arch section, on impact of the sole during running.

2. Footwear as set forth in claim 1 particularly adapted for persons about seventeen years of age and older, said arch section at the medial side of the sole being elevated for supporting the bottom of the arch of the foot at an elevation of about 2 cm above said line.

3. Footwear as set forth in claim 1 particularly adapted for persons about 10–17 years old, said arch section at the medial side of the sole being elevated for supporting the bottom of the arch of the foot at an elevation of about 1.5 cm above said line.

4. Footwear as set forth in claim 1 particularly adapted for persons about 7–10 years old, said arch section at the medial side of the sole being elevated for supporting the bottom of the arch of the foot at an elevation of about 1.0 cm above said line.

5. Footwear as set forth in claim 1 particularly adapted for persons about 2–7 years old, said arch section at the medial side of the sole being elevated for supporting the bottom of the arch of the foot at an elevation of about 0.5 cm above said line, the arch section being compressible at its medial side in relation to said line no more than about 0.25 cm on impact of the sole during running.

6. Footwear as set forth in claim 1 wherein the upper surface of said forward portion of the forefoot section is offset downwardly from the upper surface of the rear portion of the forefoot section, forming a shoulder extending between the sides of the sole generally transversely of the sole.

7. Footwear as set forth in claim 6 wherein, with the sole of the footwear unstressed and disposed on said horizontal surface, the upper surface of the forward portion of said forefoot section of the sole is generally horizontal.

8. Footwear as set forth in claim 6 particularly adapted for persons having relatively flat feet wherein, with the sole of the footwear unstressed and disposed on said horizontal surface, the rear portion of said forefoot section is inclined generally upwardly from the medial to the lateral side of the footwear.

9. Footwear as set forth in claim 8 wherein the upper surface of the rear portion of said forefoot section is inclined at a 1°–6° angle from the horizontal.

10. Footwear as set forth in claim 9 wherein the upper surface of the rear portion of said forefoot section is inclined at about a 3° angle from the horizontal.

11. Footwear as set forth in claim 6 particularly adapted for persons having feet with relatively high arches wherein, with the sole of the footwear unstressed and disposed on said horizontal surface, the upper surface of the rear portion of said forefoot section is inclined generally downwardly from the medial to the lateral side of the footwear.

12. Footwear as set forth in claim 11 wherein the upper surface of the rear portion of said forefoot section is inclined at a 2°–5° angle from the horizontal.

13. Footwear as set forth in claim 12 wherein the upper surface of the rear portion of said forefoot section is inclined at about a 3° angle from the horizontal.

14. Footwear as set forth in claim 1 particularly adapted for persons having flat feet wherein the included angle, constituting the angle of adduction, between a first line extending the length of the sole on the central longitudinal axis of said heel section, and a second line extending from about the midpoint of said first line to an area on the front edge of said forefoot section generally corresponding to the area at which the outer end of the second toe is adapted to lie, is from 0°–12°.

15. Footwear as set forth in claim 14 wherein said angle of adduction is about 9°.

16. Footwear as set forth in claim 1 particularly adapted for persons having feet with relatively high arches wherein the included angle, constituting the angle of adduction, between a first line extending the length of the sole on the central longitudinal axis of said heel section, and a second line extending from about the midpoint of said first line to an area on the front edge of said forefoot section generally corresponding to the area at which the outer end of the second toe is adapted to lie, is from 13°–33°.

17. Footwear as set forth in claim 16 wherein said angle of adduction is about 17°.

18. Footwear as set forth in claim 1 particularly adapted for persons having flat feet wherein said forefoot section of the sole is weakened to bend during toe push-off along a line extending transversely of the forefoot section, the included angle between said bend line and a line extending generally from the point at which the central longitudinal axis of said heel section intersects the rearward edge of the heel section to an area on the front edge of said forefoot section corresponding approximately to the area at which the outer end of the second toe is adapted to lie, being from 120°–160°.

19. Footwear as set forth in claim 18 wherein said included angle is about 135°.

20. Footwear as set forth in claim 1 particularly adapted for persons having feet with relatively high arches wherein said forefoot section of the sole is weakened to bend during toe push-off along a line extending transversely of the forefoot section, the included angle between said bend line and a line extending generally from the point at which the central longitudinal axis of said heel section intersects the rearward edge of the heel section to an area on the front edge of said forefoot section corresponding approximately to the area at which the outer end of the second toe is adapted to lie, being from 110°–150°.

21. Footwear as set forth in claim 20 wherein said included angle is about 125°.

22. Footwear as set forth in claim 1 wherein said forefoot section of the sole is weakened to bend during toe push-off in an area generally corresponding to the area on which the first metatarsal head of the foot is adapted to lie.

23. Footwear as set forth in claim 1 wherein, with the sole of the footwear unstressed and disposed on said horizontal surface, the sole is formed for supporting the central portion of the bottom of the heel at an elevation approximately 0.6 cm higher than the bottom of the foot at the ball of the foot.

24. Footwear as set forth in claim 1 wherein the central portion of the heel section of the sole is depressed, forming a recess for receiving therein the central portion of the bottom of the heel.

25. Footwear as set forth in claim 1 particularly adapted for persons having relatively flat feet wherein the upper surface of the heel section of the sole is inclined for supporting the bottom of the heel at a 1°–6° angle from the horizontal.

26. Footwear as set forth in claim 25 wherein the upper surface of the heel section of the sole is inclined for supporting the bottom of the heel at about a 3° angle from the horizontal.

27. Footwear as set forth in claim 1 particularly adapted for persons having feet with relatively high arches wherein the upper surface of the heel section of the insole is inclined for supporting the bottom of the heel at a 2°–7° angle from the horizontal.

28. Footwear as set forth in claim 28 wherein the upper surface of the heel section of the sole is inclined for supporting the bottom of the heel at about a 5° angle from the horizontal.

29. Footwear, such as a running shoe, particularly adapted for persons having relatively flat feet, comprising a sole and an upper, the sole having:

(a) a heel section for the bottom of the heel of the foot;

(b) an arch section forward of the heel section for the bottom of the arch of the foot;

(c) a forefoot section forward of the arch section having a forward portion for the metatarsal heads and toes of the foot and a rear portion for the part of the foot immediately rearward of the metatarsal heads;

(d) medial and lateral sides; the sole being so formed that when it is unstressed and disposed on a generally flat horizontal surface;

(e) the upper foot-supporting surfaces of the heel and arch sections are inclined generally downwardly from the medial to the lateral side of the sole; and (f) the upper foot-supporting surface of the rear portion of the forefoot section being inclined generally upwardly from the medial to the lateral side of the sole.

30. Footwear as set forth in claim 29 wherein the upper surface of said heel section is inclined for supporting the bottom of the heel at a 1°–6° angle from the horizontal.

31. Footwear as set forth in claim 30 wherein the upper surface of said heel section is inclined for supporting the bottom of the heel at about a 3° angle from the horizontal.

32. Footwear as set forth in claim 29 wherein the upper surface of said rear portion of the forefoot section is inclined at an angle of 1°–6° from the horizontal.

33. Footwear as set forth in claim 32 wherein the upper surface of said rear portion of the forefoot section is inclined at about a 3° angle from the horizontal.

34. Footwear as set forth in claim 29 wherein the upper surface of the forward portion of said forefoot section is downwardly offset from the upper surface of the rear portion of the forefoot section, forming a shoulder extending transversely of the sole between opposite sides of the sole.

35. Footwear as set forth in claim 34 wherein the upper surface of the forward portion of said forefoot section is generally horizontal.

36. Footwear as set forth in claim 29 wherein the included angle, constituting the angle of adduction, between a first line extending the length of the sole on the central longitudinal axis of said heel section, and a second line extending from about the midpoint of said first line to an area on the front edge of said forefoot section generally corresponding to the area at which the outer end of the second toe is adapted to lie, is from 0°–12°.

37. Footwear as set forth in claim 36 wherein said angle of adduction is about 9°.

38. Footwear as set forth in claim 29 wherein said forefoot section of the sole is weakened to bend during toe push-off along a line extending transversely of the forefoot section, the included angle between said bend line and a line extending generally from the point at which the central longitudinal axis of said heel section intersects the rearward edge of the heel section to an area on the front edge of said forefoot section corresponding approximately to the area at which the outer end of the second toe is adapted to lie, being from 120°–160°.

39. Footwear as set forth in claim 38 wherein said included angle is about 135°.

40. Footwear as set forth in claim 29 wherein said forefoot section of the sole is weakened to bend during toe push-off in an area generally corresponding to the area on which the first metatarsal head of the foot is adapted to lie.

41. Footwear as set forth in claim 29 wherein, with the sole of the footwear unstressed and disposed on said horizontal surface, the sole is formed for supporting the central portion of the bottom of the heel at an elevation approximately 0.6 cm higher than the bottom of the foot at the ball of the foot.

42. Footwear as set forth in claim 29 wherein the central portion of the heel section of the sole is depressed, forming a recess for receiving therein the central portion of the bottom of the heel.

43. Footwear as set forth in claim 29 wherein the arch section at the medial side of the sole is elevated in relation to the forefoot section for supporting the bottom of the arch of the foot at an elevation of from 0.5–3 cm above a line which, as viewed from the medial side of the shoe, extends between the upper foot-supporting surface of the heel section and an area on the upper surface of the forward portion of the forefoot section generally corresponding to the area on which the first metatarsal head is adapted to lie, said 0.5–3 cm being measured from the top of the arch section at its side vertically downwardly to said line, the arch section being compressible at its medial side in relation to said line no more than about 0.5 centimeters, as measured vertically downwardly from the top of the arch section, on impact of the sole during running.

44. Footwear as set forth in claim 43 particularly adapted for persons about seventeen years of age and older, said arch section at the medial side of the sole being elevated for supporting the bottom of the arch of the foot at an elevation of about 2 cm above said line.

45. Footwear as set forth in claim 43 particularly adapted for persons about 10–17 years old, said arch section at the medial side of the sole being elevated for supporting the bottom of the arch of the foot at an elevation of about 1.5 cm above said line.

46. Footwear as set forth in claim 43 particularly adapted for persons about 7–10 years old, said arch section at the medial side of the sole being elevated for supporting the bottom of the arch of the foot at an elevation of about 1.0 centimeters above said line.

47. Footwear as set forth in claim 43 particularly adapted for persons about 2–7 years old, said arch section at the medial side of the sole being elevated for supporting the bottom of the arch of the foot at an elevation of about 0.5 cm above said line, the arch section being compressible at its medial side in relation to said line no more than about 0.25 cm on impact of the sole during running.

48. Footwear, such as a running shoe, particularly adapted for persons having feet with relatively high arches, comprising a sole and an upper, the sole having:

(a) a heel section for the bottom of the heel of the foot;

(b) an arch section forward of the heel section for the bottom of the arch of the foot;

(c) a forefoot section forward of the arch section having a forward portion for the metatarsal heads and toes of the foot and a rear portion for the part of the foot immediately rearward of the metatarsal heads;

(d) medial and lateral sides; the sole being so formed that when it is unstressed and disposed on a flat generally horizontal surface:

(e) the upper foot-supporting surfaces of the heel and arch sections and the upper foot-supporting surface of the rear portion of the forefoot section are inclined generally downwardly from the medial to the lateral side of the sole;

(f) the upper surface of the forward portion of the forefoot section being offset downwardly from the upper surface of the rear portion of the forefoot section, forming a shoulder extending between the sides of the sole generally transversely of the sole.

49. Footwear as set forth in claim 48 wherein the upper surface of said heel section is inclined for supporting the bottom of the heel at a 2°–7° angle from the horizontal.

50. Footwear as set forth in claim 49 wherein the upper surface of said heel section is inclined for supporting the bottom of the heel at about a 5° angle from the horizontal.

51. Footwear as set forth in claim 48 wherein the upper surface of said rear portion of the forefoot section is inclined at an angle of 2°–5° from the horizontal.

52. Footwear as set forth in claim 51 wherein the upper surface of said rear portion of the forefoot section is inclined at an angle of about 3° from the horizontal.

53. Footwear as set forth in claim 48 wherein, with the sole of the footwear unstressed and disposed on said horizontal surface, the upper surface of said forward portion of the forefoot section is generally horizontal.

54. Footwear as set forth in claim 48 wherein the included angle, constituting the angle of adduction, between a first line extending the length of the sole on the central longitudinal axis of said heel section, and a second line extending from about the midpoint of said first line to an area on the front edge of said forefoot section corresponding approximately to the area at which the outer end of the second toe is adapted to lie, is from 13°–33°.

55. Footwear as set forth in claim 54 wherein said angle of adduction is about 17°.

56. Footwear as set forth in claim 48 wherein said forefoot section of the sole is weakened to bend during toe push-off along a line extending transversely of the forefoot section, the included angle between said bend line and a line extending generally from the point at which the central longitudinal axis of said heel section intersects the rearward edge of the heel section to an area on the front edge of said forefoot section corresponding approximately to the area at which the outer end of the second toe is adapted to lie, being from 110°–150°.

57. Footwear as set forth in claim 56 wherein said included angle is about 125°.

58. Footwear as set forth in claim 48 wherein said forefoot section of the sole is weakened to bend during toe push-off in an area generally corresponding to the area on which the first metatarsal head of the foot is adapted to lie.

59. Footwear as set forth in claim 48 wherein, with the sole of the footwear unstressed and disposed on said horizontal surface, the sole is formed for supporting the central portion of the bottom of the heel at an elevation approximately 0.6 cm higher than the bottom of the foot at the ball of the foot.

60. Footwear as set forth in claim 48 wherein the central portion of the heel section of the sole is depressed, forming a recess for receiving therein the central portion of the bottom of the heel.

61. Footwear as set forth in claim 48 wherein the arch section at the medial side of the sole is elevated in relation to the forefoot section for supporting the bottom of the arch of the foot at an elevation of from 0.5–3 cm above a line which, as viewed from the medial side of the shoe, extends between the upper foot-supporting surface of the heel section and an area on the upper surface of the forward portion of the forefoot section generally corresonding to the area on which the first metatarsal head is adapted to lie, said 0.5–3 cm being measured from the top of the arch section at its medial side vertically downwardly to said line, the arch section being compressible at its medial side in relation to said line no more than about 0.5 cm, as measured vertically downwardly from the top of the arch section, on impact of the sole during running.

62. Footwear as set forth in claim 61 particularly adapted for persons about seventeen years of age and older, said arch section at the medial side of the sole being elevated for supporting the bottom of the arch of the foot at an elevation of about 2 cm above said line.

63. Footwear as set forth in claim 61 particularly adapted for persons about 10–17 years old, said arch section at the medial side of the sole being elevated for supporting the bottom of the arch of the foot at an elevation of about 1.5 cm above said line.

64. Footwear as set forth in claim 61 particularly adapted for persons about 7–10 years old, said arch section at the medial side of the sole being elevated for supporting the bottom of the arch of the foot at an elevation of about 1.0 cm above said line.

65. Footwear as set forth in claim 61 particularly adapted for persons about 2–7 years old, said arch section at the medial side of the sole being elevated for supporting the bottom of the arch of the foot at an elevation of about 0.5 cm above said line, the arch section being compressible at its medial side in relation to said line no more than about 0.25 cm on impact of the sole during running.

66. An insole for placement in footwear, such as a running shoe, on the outer sole of the footwear, the insole having:

(a) a heel section for the bottom of the heel of the foot;

(b) an arch section forward of the heel section for the bottom of the arch of the foot;

(c) a forefoot section forward of the arch section having a forward portion for supporting the metatarsal heads and toes of the foot and a rear portion for supporting the part of the foot immediately rearward of the metatarsal heads;

(d) medial and lateral sides; the insole being so formed that when it is unstressed and disposed on a generally flat horizontal surface:

(e) the upper foot-supporting surfaces of said heel and arch sections are inclined generally downwardly from the medial to the lateral side of the insole;

(f) the arch section at the medial side of the insole being elevated in relation to the forefoot section for supporting the bottom of the arch of the foot at an elevation of from 0.5–3 cm above a line which, as viewed from the medial side of the shoe, extends between the upper foot-supporting surface of the heel section and an area on the upper surface of the forward portion of the forefoot section generally corresponding to the area on which the first metatarsal head is adapted to lie;

(g) the arch section being compressible at its medial side in relation to said line no more than about 0.5 cm, as measured vertically downwardly from the top of the arch section, on impact of the outer sole during running.

67. An insole as set forth in claim 66 particularly adapted for placement in footwear sized to fit persons about seventeen years of age and older, said arch section at the medial side of the insole being elevated for supporting the bottom of the foot at an elevation of about 2 cm above said line.

68. An insole as set forth in claim 66 particularly adapted for placement in footwear sized to fit persons about 10–17 years old, said arch section at the medial side of the insole being elevated for supporting the bottom of the foot at an elevation of about 1.5 cm above said line.

69. An insole as set forth in claim 66 particularly adapted for placement in footwear sized to fit persons about 7–10 years old, said arch section at the medial side of the insole being elevated for supporting the bottom of the foot at an elevation of about 1.0 cm above said line.

70. An insole as set forth in claim 66 particularly adapted for placement in footwear sized to fit persons about 2–7 years old, said arch section at the medial side of the insole being elevated for supporting the bottom of the foot at an elevation of about 0.5 cm above said line, the arch section being compressible at its medial side in relation to said line no more than about 0.25 cm on impact of the shoe during running.

71. An insole as set forth in claim 66 wherein the upper surface of said forward portion of the forefoot section is offset downwardly from the upper surface of said rear portion of the forefoot section, forming a shoulder extending between the sides of the insole generally transversely of the insole.

72. An insole as set forth in claim 71 wherein, with the insole unstressed and disposed on said horizontal surface, the upper surface of said forward portion of the forefoot section is generally horizontal.

73. An insole as set forth in claim 71 particularly adapted for persons having relatively flat feet wherein, with the insole unstressed and disposed on said horizontal surface, the rear portion of said forefoot section is inclined generally upwardly from the medial to the lateral side of the insole.

74. An insole as set forth in claim 73 wherein the upper surface of said rear portion of the forefoot section is inclined at a 1°–6° angle from the horizontal.

75. An insole as set forth in claim 74 wherein the upper surface of said rear portion of the forefoot section is inclined at about a 3° angle from the horizontal.

76. An insole as set forth in claim 71 particularly adapted for persons having feet with relatively high arches wherein, with the insole unstressed and disposed on said horizontal surface, the upper surface of said rear portion of the forefoot section is inclined generally downwardly from the medial to the lateral side of the insole.

77. An insole as set forth in claim 76 wherein the upper surface of said rear portion of the forefoot section is inclined at a 2°–5° angle from the horizontal.

78. An insole as set forth in claim 77 wherein the upper surface of said rear portion of the forefoot section is inclined at about a 3° angle from the horizontal.

79. An insole as set forth in claim 71 particularly adapted for persons having flat feet wherein said shoulder extends from the lateral toward the medial side of the insole along a line, constituting a great toe break line, the included angle between the great toe break line and a line extending generally from the point at which the central longitudinal axis of said heel section intersects the rearward edge of the heel section to an area on the front edge of said forefoot section generally corresponding to the area at which the outer end of the second toe is adapted to lie, being from 120°–160°.

80. An insole as set forth in claim 79 wherein said included angle is about 135°.

81. An insole as set forth in claim 71 particularly adapted for persons having feet with relatively high arches wherein said shoulder extends from the lateral toward the medial side of the insole along a line, constituting a great toe break line, the included angle between the great toe break line and a line extending from the point at which the central longitudinal axis of said heel section intersects the rearward edge of the heel section to an area on the front edge of said forefoot section generally corresponding to the area at which the outer end of the second toe is adapted to lie, being from 110°–150°.

82. An insole as set forth in claim 81 wherein said included angle is about 125°.

83. An insole as set forth in claim 66 particularly adapted for persons having flat feet wherein the included angle, constituting the angle of addution, between a first line extending the length of the insole on the central longitudinal axis of said heel section, and a second line extending from about the midpoint of said first line to an area on the front edge of said forefoot section generally corresponding to the area at which the outer end of the second toe is adapted to lie, is from 0°–12°.

84. An insole as set forth in claim 83 wherein said angle of adduction is about 9°.

85. An insole as set forth in claim 66 particularly adapted for persons having feet with relatively high arches wherein the included angle, constituting the angle of adduction, between a first line extending the length of the insole on the central longitudinal axis of said heel section, and a second line extending from about the midpoint of said first line to an area on the front edge of said forefoot section generally corresponding to the area at which the outer end of the second toe is adapted to lie, is from 13°–33°.

86. An insole as set forth in claim 85 wherein said angle of adduction is about 17°.

87. An insole as set forth in claim 66 wherein, with the insole unstressed and disposed on said horizontal surface, the insole is formed for supporting the central portion of the bottom of the heel at an elevation approximately 0.6 cm higher than the bottom of the foot at the ball of the foot.

88. An insole as set forth in claim 66 wherein the central portion of the heel section of the insole is depressed, forming a recess for receiving therein the central portion of the bottom of the heel.

89. An insole as set forth in claim 66 particularly adapted for persons having relatively flat feet wherein the upper surface of the heel section of the insole is inclined for supporting the bottom of the heel at a 1°–6° angle from the horizontal.

90. An insole as set forth in claim 89 wherein the upper surface of the heel section of the insole is inclined for supporting the bottom of the heel at about a 3° angle from the horizontal.

91. An insole as set forth in claim 66 particularly adapted for persons having feet with relatively high arches wherein the upper surface of the heel section of the insole is inclined for supporting the bottom of the heel at a 2°–7° angle from the horizontal.

92. An insole as set forth in claim 91 wherein the upper surface of the heel section of the insole is inclined for supporting the bottom of the heel at about a 5° angle from the horizontal.

93. An insole for placement in footwear, such as a running shoe, on the outer sole of the footwear, the insole being particularly adapted for persons having relatively flat feet and having:

(a) a heel section for the bottom of the heel of the foot;

(b) an arch section forward of the heel section for the bottom of the arch of the foot;

(c) a forefoot section forward of the arch section having a forward portion for the metatarsal heads and toes of the foot and a rear portion for the part of the foot immediately rearward of the metatarsal heads;

(d) medial and lateral sides;

the insole being so formed that when it is unstressed and disposed on a generally flat horizontal surface:

(e) the upper foot-supporting surfaces of said heel and arch sections are inclined generally downwardly from the medial to the lateral side of the insole; and (f) the upper foot-supporting surface of said rear portion of the forefoot section being inclined generally upwardly from the medial to the lateral side of the insole.

94. An insole as set forth in claim 93 wherein the upper surface of said heel section is inclined for supporting the bottom of the heel at a 1°–6° angle from the horizontal.

95. An insole as set forth in claim 94 wherein the upper surface of said heel section is inclined for supporting the bottom of the heel at about a 3° angle from the horizontal.

96. An insole as set forth in claim 93 wherein the upper surface of said rear portion of the forefoot section is inclined at an angle of 1°–6° from the horizontal.

97. An insole as set forth in claim 96 wherein the upper surface of said rear portion of the forefoot section is inclined at about a 3° angle from the horizontal.

98. An insole as set forth in claim 93 wherein the upper surface of said forward portion of the forefoot section of the insole is downwardly offset from the upper surface of the rear portion of the forefoot section, forming a shoulder extending transversely of the insole between opposite sides of the insole.

99. An insole as set forth in claim 98 wherein said forward portion of the forefoot section is generally horizontal.

100. An insole as set forth in claim 98 wherein said shoulder extends fromn the lateral toward the medial side of the insole along a line, constituting a great toe break line, the included angle between said great toe break line and a line extending generally from the point at which the central longitudinal axis of said heel section intersects the rearward edge of the heel section to an area on the front edge of said forefoot section generally corresponding to the area at which the outer end of the second toe is adapted to lie, being from 120°–160°.

101. An insole as set forth in claim 100 wherein said included angle is about 135°.

102. An insole as set forth in claim 93 wherein the included angle, constituting the angle of adduction, between a first line extending the length of the insole on the central longitudinal axis of said heel section, and a second line extending from about the midpoint of said first line to an area on the front edge of said forefoot section generally corresponding to the area at which the outer end of the second toe is adapted to lie, is from 0°–12°.

103. An insole as set forth in claim 102 wherein said angle of adduction is about 9°.

104. An insole as set forth in claim 93 wherein, with the insole unstressed and disposed on said horizontal surface, the insole is formed for supporting the central portion of the bottom of the heel at an elevation approximately 0.6 cm higher than the bottom of the foot at the ball of the foot.

105. An insole as set forth in claim 93 wherein the central portion of the heel section of the insole is depressed, forming a recess for receiving therein the central portion of the bottom of the heel.

106. An insole as set forth in claim 93 wherein the arch section at the medial side of the insole is elevated in relation to the forefoot section for supporting the bottom of the arch of the foot at an elevation of from 0.5–3 cm above a line which, as viewed from the medial side of the shoe, extends between the upper foot-supporting surface of the heel section and an area on the upper surface of the forward portion of the forefoot section generally corresponding to the area on which the first metatarsal head is adapted to lie, said 0.5–3 cm being measured from the top of the arch section at its inner side vertically downwardly to said line, the arch section being compressible at its medial side in relation to said line no more than about 0.5 cm, as measured vertically downwardly from the top of the arch section, on impact of the shoe during running.

107. An insole as set forth in claim 106 particularly adapted for placement in footwear sized to fit persons about seventeen years of age and older, said arch section at the medial side of the insole being elevated for supporting the bottom of the foot at an elevation of about 2 cm above said line.

108. An insole as set forth in claim 106 particularly adapted for placement in footwear sized to fit persons about 10–17 years old, said arch section at the medial side of the insole being elevated for supporting the bottom of the foot at an elevation of about 1.5 cm above said line.

109. An insole as set forth in claim 106 particularly adapted for placement in footwear sized to fit persons about 7–10 years old, said arch section at the medial side of the insole being elevated for supporting the bottom of the foot at an elevation of about 1.0 cm above said line.

110. An insole as set forth in claim 106 particularly adapted for placement in footwear sized to fit persons about 2–7 years old, said arch section at the medial side of the insole being elevated for supporting the bottom of the foot at an elevation of about 0.5 cm above said line, the arch section being compressible at its medial side in relation to said line no more than about 0.25 cm on impact of the outer sole during running.

111. An insole for placement in footwear, such as a running shoe, on the outer sole of the footwear, the insole being particularly adapted for persons having feet with relatively high arches and having:

(a) a heel section for the bottom of the heel of the foot;

(b) an arch section forward of the heel section for the bottom of the arch of the foot;

(c) a forefoot section forward of the arch section having a forward portion for the metatarsal heads and toes of the foot and a rear portion for the part of the foot immediately rearward of the metatarsal heads;

(d) medial and lateral sides;

the insole being so formed that when it is unstressed and disposed on a flat generally horizontal surface:

(e) the upper foot-supporting surfaces of said heel and arch sections and the upper foot-supporting surface of said rear portion of the forefoot section are inclined generally downwardly from the medial to the lateral side of the insole; and (f) the upper surface of said forward portion of the forefoot section being offset downwardly from the upper surface of said rear portion of the forefoot section, forming a shoulder extending transversely of the insole between opposite sides of the insole.

112. An insole as set forth in claim 111 wherein the upper surface of the heel section of the insole is inclined for supporting the bottom of the heel at a 2°–7° angle from the horizontal.

113. An insole as set forth in claim 112 wherein the upper surface of said heel section is inclined for supporting the bottom of the heel at about a 5° angle from the horizontal.

114. An insole as set forth in claim 111 wherein the upper surface of said rear portion of the forefoot section is inclined at an angle of 2°–5° from the horizontal.

115. An insole as set forth in claim 114 wherein the upper surface of the rear portion of the forefoot section is inclined at an angle of about 3° from the horizontal.

116. An insole as set forth in claim 111 wherein, with the insole unstressed and disposed on said horizontal surface, the upper surface of said forward portion of the forefoot section is generally horizontal.

117. An insole as set forth in claim 111 wherein the included angle, constituting the angle of adduction, between a first line extending the length of the insole on the central longitudinal axis of said heel section, and a second line extending from about the midpoint of said first line to an area on the front edge of said forefoot section generally corresponding to the area at which the outer end of the second toe is adapted to lie, is from 13°–33°.

118. An insole as set forth in claim 117 wherein said angle of adduction is about 17°.

119. An insole as set forth in claim 111 wherein said shoulder extends along a line, constituting a great toe break line, the included angle between said great toe break line and a line extending generally from the point at which the central longitudinal axis of said heel section intersects the rearward edge of the heel section to an area on the front edge of said forefoot section generally corresponding to the area at which the outer end of the second toe is adapted to lie, being from 110°–150°.

120. An insole as set forth in claim 119 wherein said included angle is about 125°.

121. An insole as set forth in claim 111 wherein, with the insole unstressed and disposed on said horizontal surface, the insole is formed for supporting the central bottom portion of the heel at an elevation approximately 0.6 cm higher than the bottom of the foot at the ball of the foot.

122. An insole as set forth in claim 111 wherein the central portion of the heel section of the insole is depressed, forming a recess for receiving therein the central portion of the bottom of the heel.

123. An insole as set forth in claim 111 wherein the arch section at the medial side of the insole is elevated in relation to the forefoot section for supporting the bottom of the arch of the foot at an elevation of from 0.5–3 cm above a line which, as viewed from the medial side of the shoe, extends between the upper foot-supporting surface of the heel section and an area on the upper surface of the forward portion of the forefoot section generally corresponding to the area on which the first metatarsal head is adapted to lie, the arch section being compressible at its medial side in relation to said line no more than about 0.5 cm, as measured vertically downwardly from the top of the arch section, on impact of the outer sole during running.

124. An insole as set forth in claim 123 particularly adapted for placement in footwear sized to fit persons about seventeen years of age and older, said arch section at the medial side of the insole being elevated for supporting the bottom of the foot at an elevation of about 2 cm above said line.

125. An insole as set forth in claim 123 particularly adapted for placement in footwear sized to fit persons about 10–17 years old, said arch section at the medial side of the insole being elevated for supporting the bottom of the foot at an elevation of about 1.5 cm above said line.

126. An insole as set forth in claim 123 particularly adapted for placement in footwear sized to fit persons about 7–10 years old, said arch section at the medial side of the insole being elevated for supporting the bottom of the foot at an elevation of about 1.0 cm above said line.

127. An insole as set forth in claim 123 particularly adapted for placement in footwear sized to fit persons about 2–7 years old, said arch section at the medial side of the insole being elevated for supporting the bottom of the foot at an elevation of about 0.5 cm above said line, the arch section being compressible at its medial side in relation to said line no more than about 0.25 cm on impact of the outer sole during running.

* * * * *

UNITED STATES PATENT AND TRADEMARK OFFICE

CERTIFICATE OF CORRECTION

PATENT NO. : 4,272,899

DATED : June 16, 1981

INVENTOR(S) : Jeffrey S. Brooks

It is certified that error appears in the above—identified patent and that said Letters Patent is hereby corrected as shown below:

Column 1, line 67, "vértically" should read --vertically--. Column 3, line 66, "metal" should read --medial--. Column 7, line 26, there should not be a parenthesis before "no". Column 8, claim 1, line 67, "sole" should read --medial--. Column 11, claim 28, line 8, "claim 28" should read --claim 27--. Column 16, claim 83, line 43, "addution" should read --adduction--. Column 18, claim 100, line 5, "fromn" should read --from--.

Signed and Sealed this

*Twenty-second* Day of *September 1981*

[SEAL]

*Attest:*

GERALD J. MOSSINGHOFF

*Attesting Officer*

*Commissioner of Patents and Trademarks*